US007984734B2

(12) United States Patent
Cepress et al.

(10) Patent No.: US 7,984,734 B2
(45) Date of Patent: Jul. 26, 2011

(54) ROUTER TABLE WITH MECHANICAL DRIVE

(75) Inventors: Carl Alexander Cepress, Chicago, IL (US); Bobby Brent Boyd, Schaumburg, IL (US); John Charles Derler, Chicago, IL (US); Stefanie Danielle Reynolds, Naperville, IL (US); Carl Christian Carlson, Vernon Hills, IL (US)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 12/183,878

(22) Filed: Jul. 31, 2008

(65) Prior Publication Data

US 2009/0056833 A1 Mar. 5, 2009

Related U.S. Application Data

(60) Provisional application No. 60/962,933, filed on Aug. 1, 2007.

(51) Int. Cl.
*B27C 5/00* (2006.01)
*B25H 1/00* (2006.01)

(52) U.S. Cl. ..... 144/134.1; 144/286.5; 144/136.1

(58) Field of Classification Search ..... 144/136.1, 144/136.95, 154.5, 286.1–287, 134.1, 285; 409/180–182; 408/128, 228, 229
See application file for complete search history.

(56) References Cited

U.S. PATENT DOCUMENTS

| | | | | | |
|---|---|---|---|---|---|
| 2,183,258 | A | | 12/1939 | Harman | |
| 2,572,756 | A | * | 10/1951 | Plimmer et al. | 29/26 R |
| 3,134,411 | A | | 5/1964 | Broyles | |
| 4,102,246 | A | * | 7/1978 | Okamoto | 409/112 |
| 4,105,055 | A | | 8/1978 | Brenta | |
| 4,230,162 | A | | 10/1980 | Miller | |
| 4,450,882 | A | * | 5/1984 | Hitchcock et al. | 144/402 |
| 4,537,234 | A | | 8/1985 | Onsrud | |
| 4,557,303 | A | * | 12/1985 | Gardner et al. | 144/145.2 |
| 4,655,268 | A | | 4/1987 | Lundblom | |
| 5,305,525 | A | * | 4/1994 | Susnjara et al. | 29/898.07 |
| 5,419,252 | A | | 5/1995 | Satake | |
| 5,725,036 | A | * | 3/1998 | Walter | 144/135.2 |
| 5,730,672 | A | * | 3/1998 | Lin | 474/88 |
| 5,769,579 | A | * | 6/1998 | Stutsman | 409/203 |
| 6,305,887 | B1 | * | 10/2001 | Wang | 409/229 |
| 6,550,154 | B1 | * | 4/2003 | Smith | 33/638 |
| 6,645,054 | B2 | | 11/2003 | Raffo, Sr. | |
| D538,614 | S | | 3/2007 | Aglassinger | |
| 7,369,916 | B2 | | 5/2008 | Etter et al. | |

OTHER PUBLICATIONS

International Search Report in corresponding PCT application (i.e. PCT/US2008/071857), 2 pages.

* cited by examiner

*Primary Examiner* — Shelley Self
(74) *Attorney, Agent, or Firm* — Maginot, Moore & Beck

(57) ABSTRACT

A router table comprises a table top, a bit mount, and a drive train. The bit mount is configured to hold a router bit such that the router bit extends from the table top defining a bit axis. The drive train is positioned under the table top and is operably connected between the bit mount and a drive coupling. The drive coupling is configured to engage a driven member, with the drive coupling defining a drive axis that is not coaxial with the bit axis. The driven member may be provided by a drive bit on a portable router secured to the table top. Operation of the portable router results in rotation of the driven member. Rotation of the driven member and associated drive coupling operates the drive train and results in rotation of the bit mount and associated router bit.

18 Claims, 11 Drawing Sheets

ROUTER TABLE WITH MECHANICAL DRIVE

FIELD

The present disclosure relates to power tools and particularly to routers which may be used to machine features into wood or other materials.

BACKGROUND

Routers are used for a variety of material working purposes (e.g., woodworking) including finishing work for furniture and cabinets as well as functional connections made of complimentary shaped profiles such as tongue and groove joints, etc.

Routers typically are of two types: router tables in which the workpiece is moved relative to a stationary router and portable routers that are moved along the workpiece.

Portable routers typically comprise a pneumatic or electric motor that is located in a housing. The housing moves axially along a base. An exemplary prior art router 10 is shown in FIG. 8. The router 10 includes router bit 12 attached to the router 10 by a chuck 14. A collet may alternatively be used. The chuck 14 extends from a drive shaft 16 of motor 18 and is positioned perpendicular to face 20 of base 22 such that the face 20 of the base 22 is translated along a surface 24 of work piece 26 with the bit 12 extending from the face 20 to perform the work on the work piece 26. The bit 12 may include a pilot that rides against a shoulder 30 of the work piece 26 to control the cut. An example of a portable router is more fully described in U.S. Design Pat. No. D 538,614 to Aglassinger, the disclosure of which is incorporated by reference in its entirety.

Router tables utilize a router bit that extends upwardly above the top of the table. The router bit is stationary and is positioned in alignment with a longitudinally extending fence. The workpiece is advanced from right to left along the top of the table, along the fence, and into the router bit to perform the work. The router bit may be powered by a dedicated motor positioned under the table. Alternatively, the router bit may be powered by a portable router positioned under the table with the router bit extending upwardly through the table. An example of a table utilizing a dedicated motor is more fully described in U.S. Pat. No. 4,537,234 to Onsrud, the disclosure of which is incorporated by reference in its entirety. An example of a table utilizing a portable router is Bosch model is RA1171 Router Table sold by Robert Bosch GmbH, Stuttgart, Germany.

Routers vary is size, power and weight. Routers used for router tables may have a power capacity of up to three and one-half horsepower, and these routers tend to be very large and heavy. Accordingly, the installation and removal of these routers from the underside of a table may involve significant effort.

In view of the foregoing, it would be advantageous to provide a router table that provides for easy installation and removal of a router to and from a table. It would also be advantageous if the router could be used for other tasks once removed from the router table.

SUMMARY

In accordance with at least one embodiment of a router table with mechanical drive train, a router table comprises a table top, a bit mount, and a drive train. The bit mount is configured to hold a router bit such that the router bit extends from the table top defining a bit axis. The drive train is operably connected between the bit mount and a drive coupling. The drive coupling is configured to engage a driven member that is driven by a power source. The drive coupling defines a drive axis that is not coaxial with the bit axis. Rotation of the driven member and associated drive coupling operates the drive train and results in rotation of the bit mount and associated router bit.

According to at least one embodiment, a table router comprises a table top including a substantially planar upper surface. A router bit extends outward from the substantially planar upper surface of the table top. A portable router with a rotatable drive shaft is seated on the substantially planar upper surface of the table top. A drive train is positioned beneath the table top and operably connects a driven member on the portable router to the router bit. The drive train is configured to rotate the router bit when the drive shaft of the portable router is rotated.

The router table with mechanical drive provides for a method of driving a router bit on a router table. The method comprises positioning the router bit on a bit mount such that the router bit extends away from an upper surface of a table top. The method further comprises seating a portable router on the upper surface of the table top such that a driven member on the portable router is operably connected to a drive train positioned under the table top. In addition, the method comprises rotating the driven member on the portable router in order to operate the drive train and rotate the router bit in the bit mount.

Pursuant to another embodiment, there is provided a routing kit that may be used to shape workpieces with a selectable one of a stationary workpiece and with a moveable workpiece. The routing kit includes a router bit, a portable router, a table, a router bit mount, and a drive. The portable router has a portable router connector for receiving the router bit. The table connects to the portable router. The portable router connector of the portable router has a portable router axis of rotation when secured to the table. The router bit mount has a rotating portion including a router bit connector for securing the router bit to the router bit mount. The rotating portion of the router bit mount has a router bit mount axis of rotation. The router bit mount axis of rotation is spaced from the portable router axis of rotation when the portable router is secured to the table. The drive connects the portable router connector to the rotating portion of the router bit mount.

While it would be desirable to provide a router table that provides this or other advantageous features as may be apparent to those reviewing this disclosure, the teachings disclosed herein extend to those embodiments which fail within the scope of the appended claims, regardless of whether they accomplish the above-mentioned or other advantages.

BRIEF DESCRIPTION OF THE DRAWINGS

Corresponding reference characters indicate corresponding parts throughout the several views. Like reference characters indicate like parts throughout the several views

DETAILED DESCRIPTION

Figure 1:
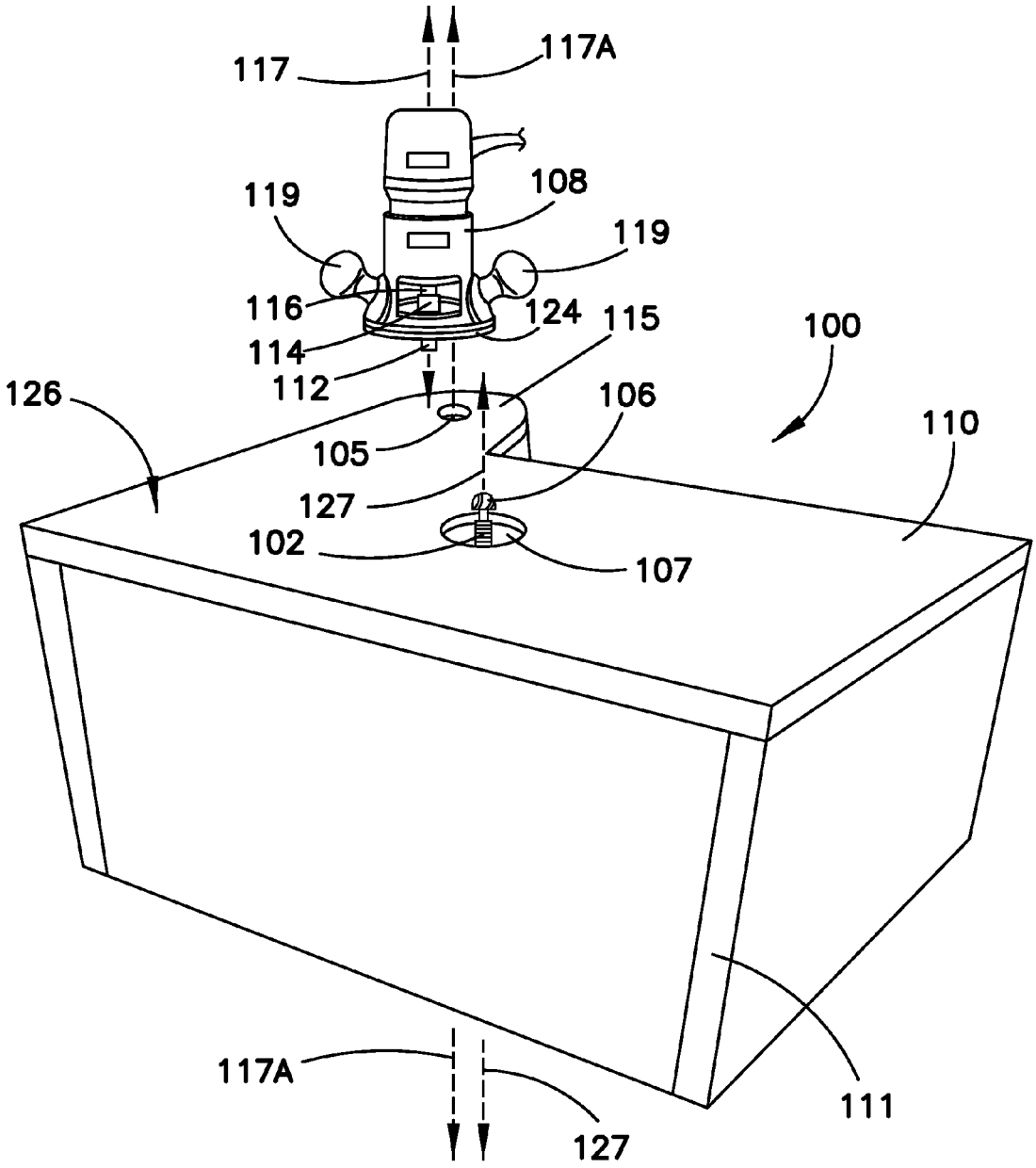
FIG. 1 is a perspective view of a router table with mechanical drive configured for use with a portable router positioned on a table top.
Figure 2:
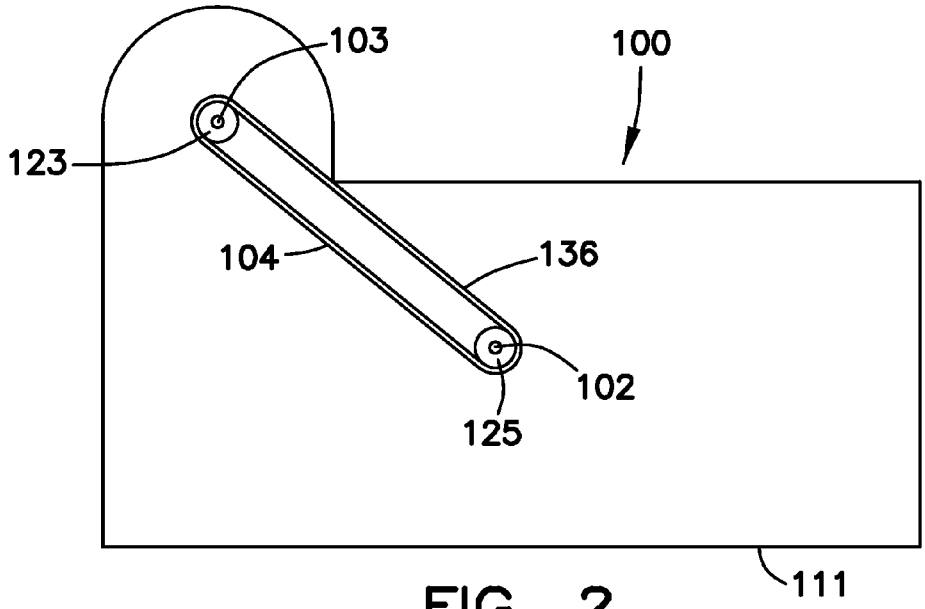
FIG. 2 is a plan view of the router table of FIG. 1 showing a drive train of the router table.
Figure 3:
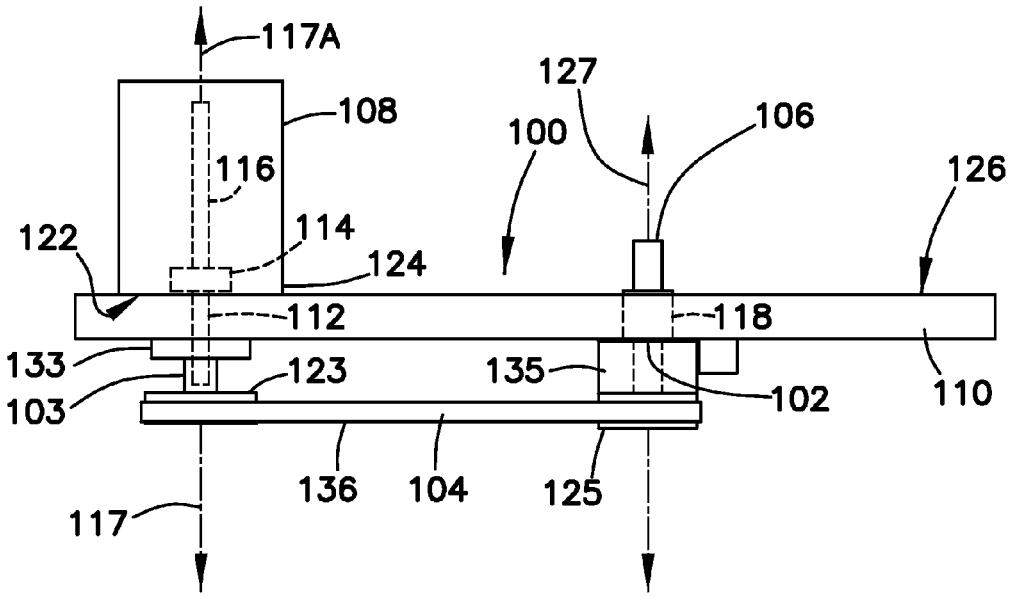
FIG. 3 is an elevation view of the router table of FIG. 1 with a front panel removed to show the components positioned above and below the table top.

According to an embodiment of the present disclosure and referring to FIGS. 1-3, a router table 100 is shown. The router table 100 includes a table top 110, a router bit mount 102, a drive coupling 103, and a drive train 104 connected between the router bit mount 102 and the drive coupling 103. The router table 100 is configured for use with router bit 106 and a portable router 108. The router table 100 is configured to permit an operator to utilize the portable router 108 to serve as a power source for a router table.

As shown in FIG. 1, the router table 100 includes a table top 110 and a frame 111 supporting the table top. The frame 111 may include legs, feet, side panels, or any other structural members desired for supporting the table top 110. The table top 110 includes a substantially planar upper surface 126 which allows the user to slide a working piece across the table top. The table top 110 includes two holes including a drive hole 105 and a bit hole 107. As explained in further detail below, a driven member 112 of the portable router is configured to fit within the drive hole 105 and a router bit 106 is configured to fit within the bit hole 107. The table top 110 may be any of numerous shapes, such as for example, the generally rectangular shape shown in FIG. 1. The table top 110 may further include a peninsula 115 provided at a corner portion, the peninsula being designed to seat the portable router 108 or other power source.

As shown in FIG. 1, the portable router 108 includes two handles 119, allowing a user to grasp the portable router 108 in his or her hands and maneuver the router 108. The portable router 108 further comprises a rotating drive shaft 116 that is connected to a chuck 114 or other attachment member of the portable router 108. The drive shaft 116 defines a portable router axis of rotation 117. A driven member 112 is connected to the chuck 114 such that rotation of the drive shaft 116 results in rotation of the driven member 112. The driven member is configured to fit within a drive hole 105 on the table top and join to the drive coupling 103.

FIG. 2 shows a plan view of the router table 100 including the drive coupling 103 and the bit mount 102 connected by the drive train 104. In the embodiment of FIG. 2, the drive train 104 includes a belt 136 connected between a drive pulley 123 and a bit pulley 125. The drive pulley 123 is connected to the drive coupling 103 and the bit pulley 125 is connected to the bit mount 102. The belt 136 translates rotation of the drive coupling 103 and the associated drive pulley 123 into rotation of the bit pulley 125 and the associated bit mount. While a belt 136 and pulleys 123, 125 have been shown in the embodiment of FIG. 2 as the drive train 104, it will be realized that other configurations of the drive train are possible. For example, the drive train 104 may comprise a chain or a plurality of cooperating gears, or any appropriate combination of these or other drive train members as will be recognized by those in the art.

FIG. 3 shows an elevation view of the table top 110 of the router table 100 with the portable router 108 positioned on the table top 110. As shown in dashed lines, the driven member 112 which is connected to the portable router via chuck 114 extends through the hole 105 in the table top 110 and is connected to drive coupling 103. It will be recognized that drive coupling 103 may be provided in any of various forms to join the drive bit 112 to the drive coupling 103. For example, the drive bit 112 may be provided in the form of a chuck or collet. Alternatively, drive coupling 103 may be provided as a shaped hole (e.g., a square hole) formed in a rotating member, and the drive bit 112 may be provided as a complimentary shaped rod that extends into the hole. In any event, the rotatable drive coupling 103 defines a drive axis 117A about which the drive shaft 116 of the router 108 and the drive bit 112 rotate when the drive bit 112 is positioned in the bit coupling 103.

With continued reference to FIG. 3, the rotatable drive coupling 103 is secured in place with a support 133 that is connected to the under side of the table top 110. The support 133 allows the drive coupling 103 to rotate about the drive axis 117A, but retains the drive coupling 103 in place relative to the table top 110.

The rotatable drive coupling 103 is connected to the rotatable drive pulley 123. The belt 123 extends between the drive pulley 123 and the rotatable bit pulley 125. The bit pulley 125, in turn, is connected to the bit mount 102. With this arrangement, when the drive bit 112 is rotated by portable router 108, power is translated to the drive train 104 and the bit mount 102, resulting in rotation of the router bit 106 extending outward from the table top about bit axis 127.

As also shown in FIG. 3, the router bit mount 102 includes a rotatable extended portion 118 that is configured to extend through the bit hole 107 in the table top 110. The extended portion 118 of the router bit mount 102 may comprise a chuck or collet or other appropriate connector used to secure the router bit 106 to the bit mount 102. The extended portion 118 is connected to the drive train 104 via the bit pulley 125. The extended portion is held in place relative to the underside of the table top 110 using a support 135. The support 135 allows the extended portion 118 to rotate about bit axis 127, while securing the extended portion in place relative to the table top 110.

With reference to FIGS. 1 and 3, the portable router 108 is removably secured to table top 110. The portable router 108 may include bottom surface 122 of base 124 of the portable router 108. The bottom surface 122 of the base 124 of the router 108 may rest on the upper planar surface 126 of the table top 110. When the portable router is seated on the table top 110, the router axis or rotation 117 is coaxial with the drive coupling axis of rotation 117A. The drive coupling axis 117A is parallel with the bit axis 127, but they are not coaxial.

Instead, the drive coupling axis 117A is spaced apart from the bit axis 127 on the table top 110.

Figure 3A:
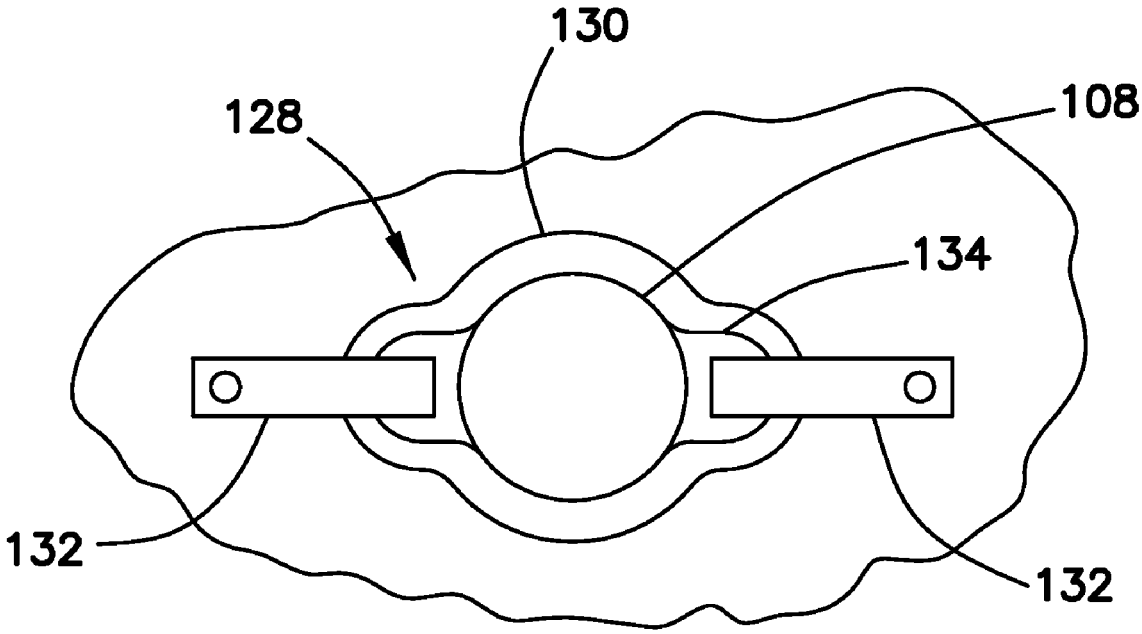
FIG. 3A is a partial top view of the routing table of FIG. 1 showing a bracket to hold the portable router on the table top.

When the portable router is seated on the table top 110, the weight of the portable router 108 may be sufficient to prevent rotation of the portable router 108 with respect to the table top 110. Alternatively, the table top 110 may include a seat in the form of a bracket 128 or other mechanism for securing the portable router 108 to the table top 110. The seat 128 may, as shown in FIG. 3A, be in the form of a vertical wall 130 having a shape conforming to that of base 124 of the router 108. Alternatively the seat 128 may include clamps 132 positioned over upper surface 134 of the base 124 of the router 108. Of course, numerous other seat arrangements may be possible as will be recognized by those of skill in the art.

Figure 4:
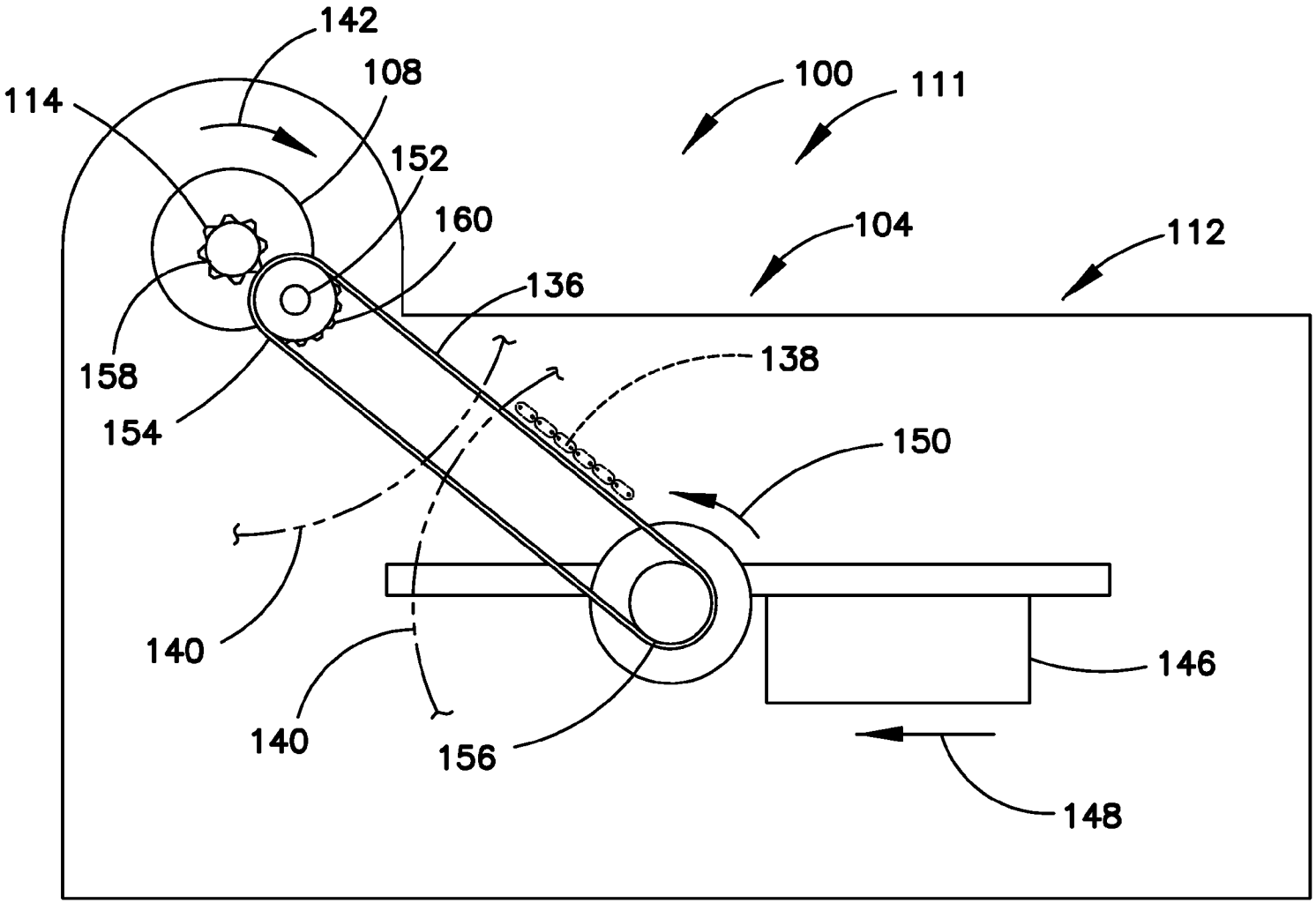
FIG. 4 is a partially cutaway top view of one embodiment of the router table of FIG. 1 showing the drive in greater detail.

Referring now to FIG. 4 an alternative embodiment of the drive train 104 of the router table 100 is shown in greater detail. In this embodiment, the chuck/rotating portion 114 of the router 108 typically rotates, when viewed from above, clockwise in the direction of arrow 142. An operator 144 when machining work piece 146 on router table 112 typically advances the work piece 146 from right to left in the direction of arrow 148 into router 106 to perform work on the work piece 146. The movement of the work piece 146 in the direction of arrows 148 from right to left is typical when using currently available router tables. This motion of work flow is very common to operators 144 and, as such, the router table 100 may be configured such that the operator 144 may utilize the router table 100 by moving the work piece 146 in the direction of arrows 148.

Utilizing standard router bits, such as router bit 106, the rotating portion 118 of the router bit mount 102 rotates in a counterclockwise direction as shown in arrows 150.

In at least one embodiment, the direction of rotation of the rotating portion 114 of the portable router 108 as shown by arrows 142 and the direction of the rotating portion 118 of the router bit mount 102 as shown by arrows 150 are opposite. Accommodation of the reversed rotation of the rotating portion 118 of mount 102 with respect to the rotating portion 114 of the portable router 108 requires that the drive train 104 reverse the rotation of the components from input to output.

The reversing of rotation direction of the drive components from input to output can be accomplished in several ways. For example, the drive train 104 of the router table 100 of the embodiment of FIG. 4 includes a router spindle or an intermediate spindle 152. An intermediate pulley 154 is mounted onto intermediate spindle 152. The belt 136 connects intermediate pulley 154 and to router bit mount pulley 156 mounted on router bit mount 102. The intermediate spindle 152 may be connected to the rotating portion 114 of the portable router 108 by any suitable manner. For example, and as shown in FIG. 4, the rotating portion 114 of the portable router 108 includes a drive gear 158 which mates with a driven gear 160 mounted onto intermediate spindle 152. Also, as represented by dotted lines 138 in FIG. 4, the belt 136 may be replaced by a chain 138 that connects the intermediate pulley 154 and to router bit mount pulley 156. Those of skill in the art will recognize that numerous other drive train configurations are possible, such as, for example, those set forth in FIGS. 4A-4E.

Figure 4B:
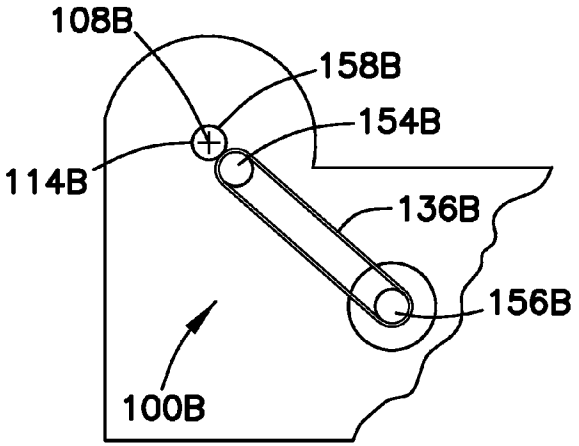
FIG. 4B is a cutaway partial top view of the router table of FIG. 4 with another alternate drive configuration.
Figure 4D:
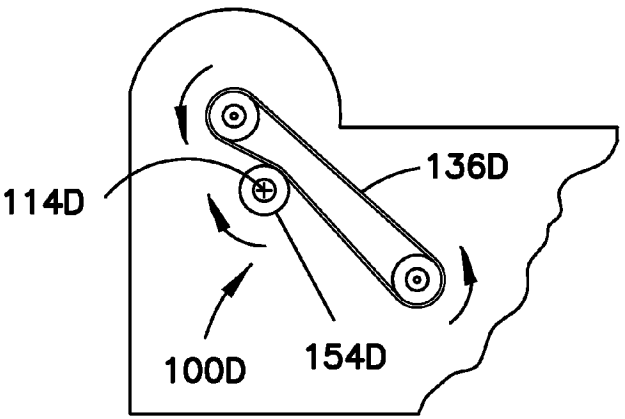
FIG. 4D is a cutaway partial top view of a router table of FIG. 4 with yet another alternate drive configuration.
Figure 4A:
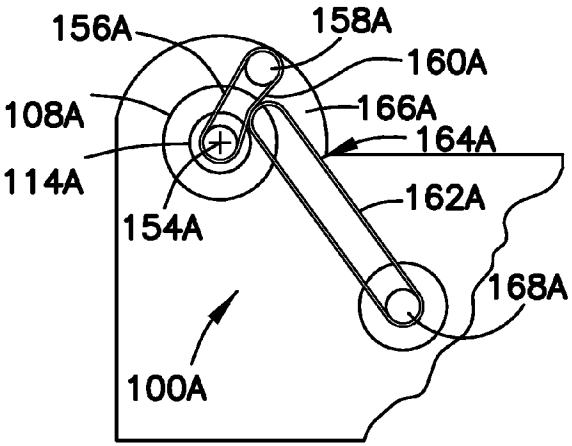
FIG. 4A is a cutaway partial top view of the router table of FIG. 4 with an alternate drive configuration.

Alternatively and referring now to FIG. 4A, the mechanism of the present disclosure may be in the form of router table 100A which includes a rotating portion 114A of portable router 108A including a pulley 154A which is connected by belt 156A to idler pulley 158A. The external surface 160A of the belt 156A may contact outer surface 162A of belt 164A connected between intermediate pulley 166A and router bit mount pulley 168A.

Alternatively and referring now to FIG. 4B, the mechanism of the present disclosure may be in the form of router table 100B which includes a belt 136B positioned between idler pulley 154B and router bit mount pulley 156B. The periphery of idler pulley 154B may be connected to a frictional drive in the form of rubber wheel 158B that is also connected to rotating portion 114B of portable router 108B.

Figure 4C:
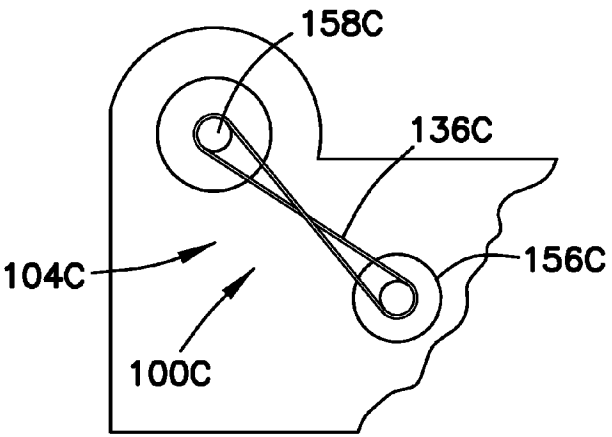
FIG. 4C is a cutaway partial top view of a router table of FIG. 4 with yet another alternate drive configuration.
Figure 8:
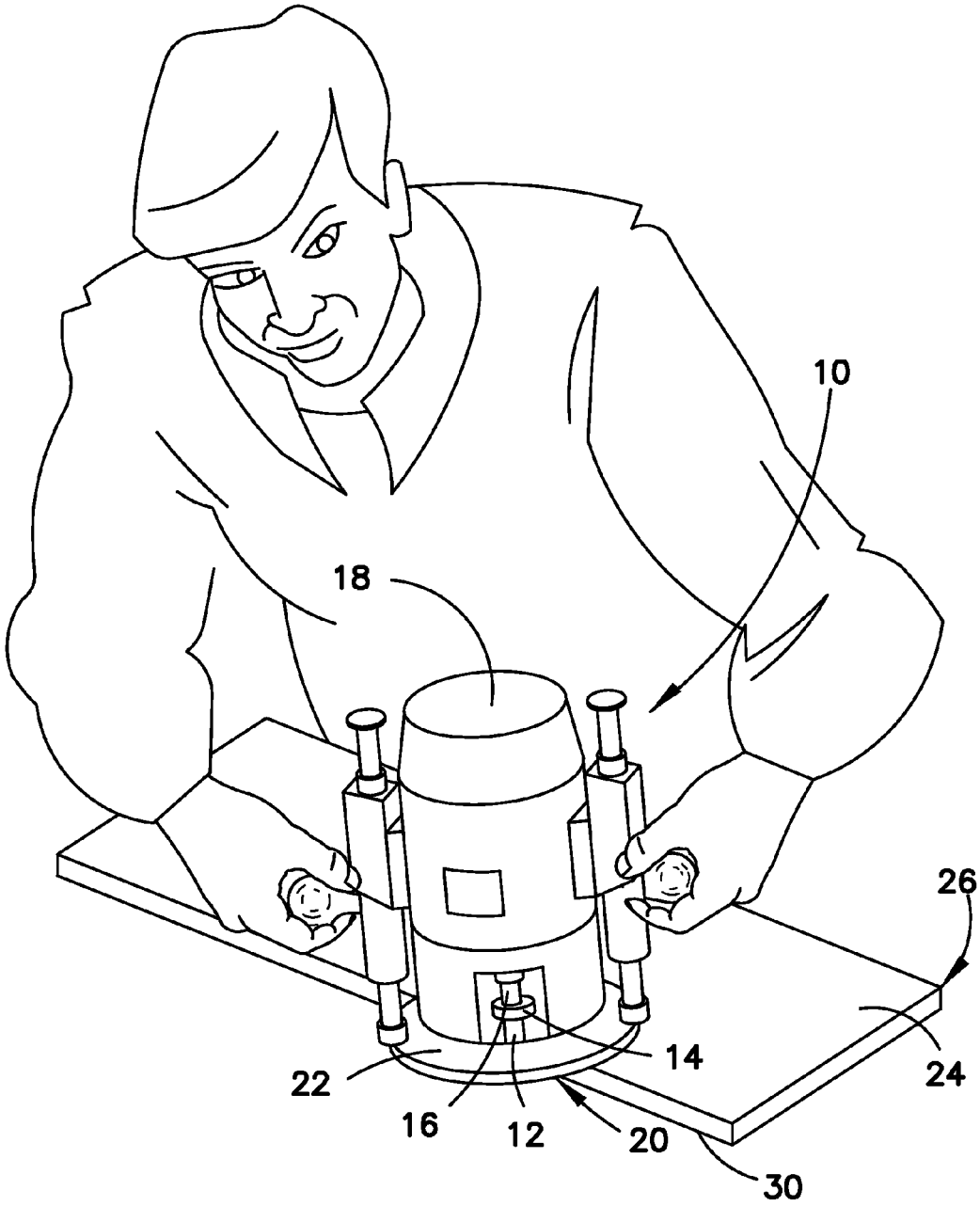
FIG. 8 PRIOR ART
FIG. 8 is a perspective view of a prior art portable router.

Alternatively and shown in FIG. 4C, the mechanism of the present disclosure may be in the form of router table 10C that includes drive train 104C having a belt 136C which is crossed or has an figure 8 shape. The figure 8-shaped belt 136C is connected to portable router pulley 158C and to router bit mount pulley 156C. The use of the figure 8-shaped belt 136C obviates the need for an intermediate spindle and intermediate drive trains.

Figure 4E:
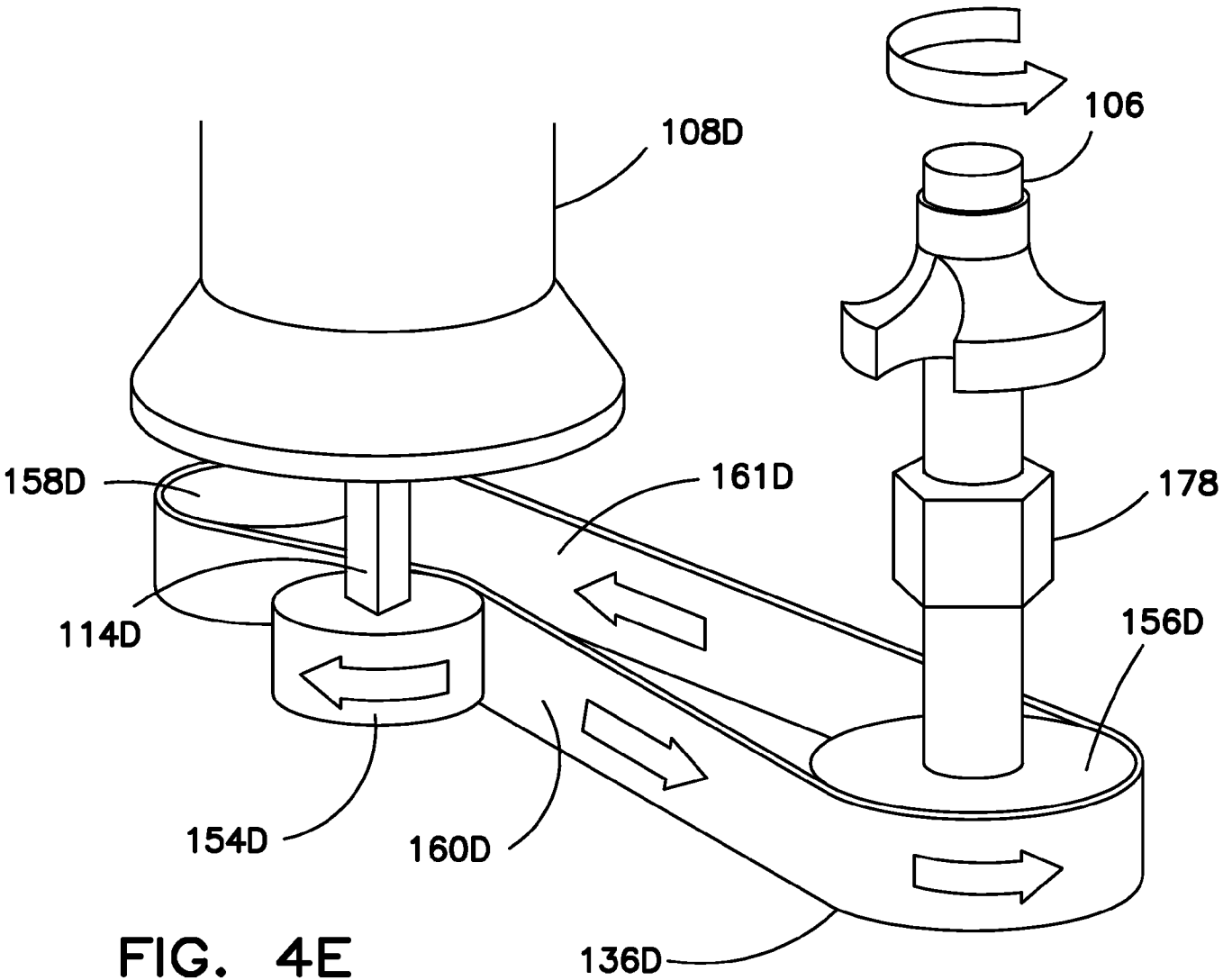
FIG. 4E is a perspective view of the drive configuration of FIG. 4D with the table top of the router table omitted.

In another alternative embodiment of the drive train shown in FIGS. 4D and 4E, the router table 100D includes a rotating portion 114D of portable router 108D. A drive pulley 154D is connected to the rotating portion 114D. The drive pulley 154D is used to drive a belt 136D which wraps around an idler pulley 158D and a bit mount pulley 156D, the bit mount pulley 156D being operably connected to the router bit mount quill 178 and the router bit 106. The belt 136D may be a double-sided belt having different configurations in different embodiments. For example, the belt 136D may be a double sided v-type belt in one embodiment and a tooth-type belt in another embodiment. The external surface 160D of the belt 136D contacts the drive pulley 154D and the inner surface 161D of the belt 136D contacts the idler pulley 158D and the bit mount pulley 156D. The configuration of the drive train of FIGS. 4D-4E allows the bit mount pulley 156D to rotate in an opposite direction from the drive pulley 154D. Also, in the embodiment of FIGS. 4D and 4E, the position of the idler pulley 158D may be adjusted in order to set the belt tension.

Figure 5:
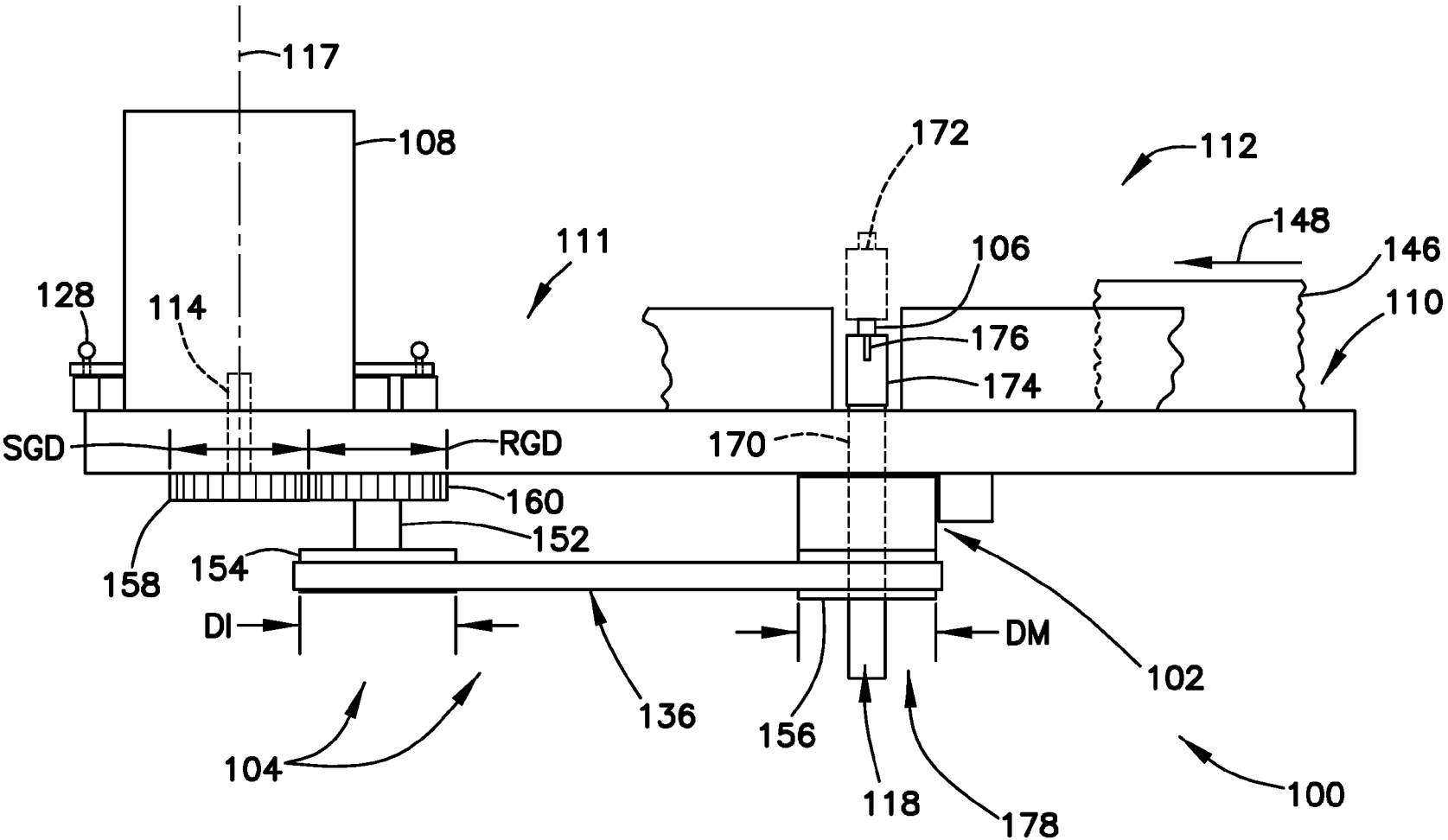
FIG. 5 is a partially cutaway elevation view of the router table of FIG. 1 showing an embodiment of the drive train in even greater detail.

Referring now to FIG. 5 the mechanical drive train 104 of the router table 100 of the embodiment of FIG. 4 is shown in greater detail. The intermediate spindle 152 may be connected to the rotating portion 114 of the portable router 108 in any suitable manner. For example, the rotating portion 114 of the portable router 108 includes drive gear 158 which mates with driven gear 160 mounted to intermediate spindle 152.

The belt 136 connects intermediate pulley 154 to router bit mount pulley 156. Typically the intermediate pulley 154 and the router bit mount pulley 156 are fixed at their rotating axes. Thus for simplicity, the rotating portion 118 of the router bit mount 102 may be fixed in a vertical direction. If fixed in a vertical direction, the rotating portion 118 of the router bit mount 102 does not accommodate a vertical adjustment of the router bit 106.

Various mechanisms may be provided to permit the router bit 106 to be moved from lower position 170 shown in solid to upper position 172 shown in phantom. For example, the router bit mount 102 may include a router bit mount chuck 174 which may permit shaft 176 and router bit 106 to be positioned in various vertical heights with respect to the chuck 174. Alternatively, the router bit mount may include an internally threaded portion and an externally threaded portion (not shown) that may be adjusted vertically.

As shown in FIG. 5, the router bit mount 102 may include a quill 178 for permitting the movement of the router bit 106 in the vertical direction. The quill 178 may be any commercially available quill such as those described in U.S. Pat. No. 2,072,646 to Cenasek or U.S. Pat. No. 3,609,055 to Luff, the disclosure of both patents being hereby incorporated by reference in their entireties.

The intermediate pulley 154 and the router bit mount pulley 156 may be standard pulleys and may be flat or V-type pulleys corresponding to a flat or a V-type belt 136, respectively. The diameter DI of the intermediate pulley 154 may be the same as the diameter DM of the router bit mount pulley 156. If the diameters DI and DM are equal, the rotational speed of the intermediate spindle 152 and the rotating portion 118 of the router bit mount 102 will be the same. Similarly, the drive gear 158 has a drive gear diameter RGD while the driven gear 160 has a driven gear diameter SGD. If the diameters RGD and SGD are the same, then the rotational speed of the rotating portion 114 of the portable router 108 will be the same as that of the intermediate spindle 152.

For simplicity, the gears 158 and 160 and the pulleys 154 and 156 may by identical to each other and may have the same diameter. Further, since the router bit 106 may be used for both for the portable router 108 and for the router table 112, the rotational speed of the rotating portion 118 of the router bit mount 102 may be similar to the rotational speed of the portable router 108. It should be appreciated that, however, the rotating portion 118 of the router bit mount 102 may be selected to be of a higher speed or a lower speed than that of the portable router 108. Therefore, the gears 158 and 160 may have different sizes and the pulleys 154 and 156 may, similarly, have different sizes. Further it should be appreciated that the pulleys 154 and 156 may be in the form of a variable speed drive. Such a variable speed drive is, for example, shown in U.S. Pat. No. 3,718,405 to Kiter, the disclosure of which is incorporated by reference in its entirety.

The portable routers 108 typically have a rotational speed of around 25,000 revolutions per minute and may have a power of, for example, three and one half (3.5) horsepower. Therefore, the selection of bearings to support the rotation of the intermediate spindle 152 and the rotational portion 118 of the router bit mounting 102 should be selected to accommodate a high rotational speed. For example, the bearings for the drive train 104 of the router table 100 may include air bearings, rolling elements bearings, or journal bearings. If rolling element bearings are utilized, the cages or retainers may be made of a plastic and the rolling elements of the bearing may be preloaded. Also, the bearing rolling elements may be ceramic to permit higher rotational speeds.

Figure 6:
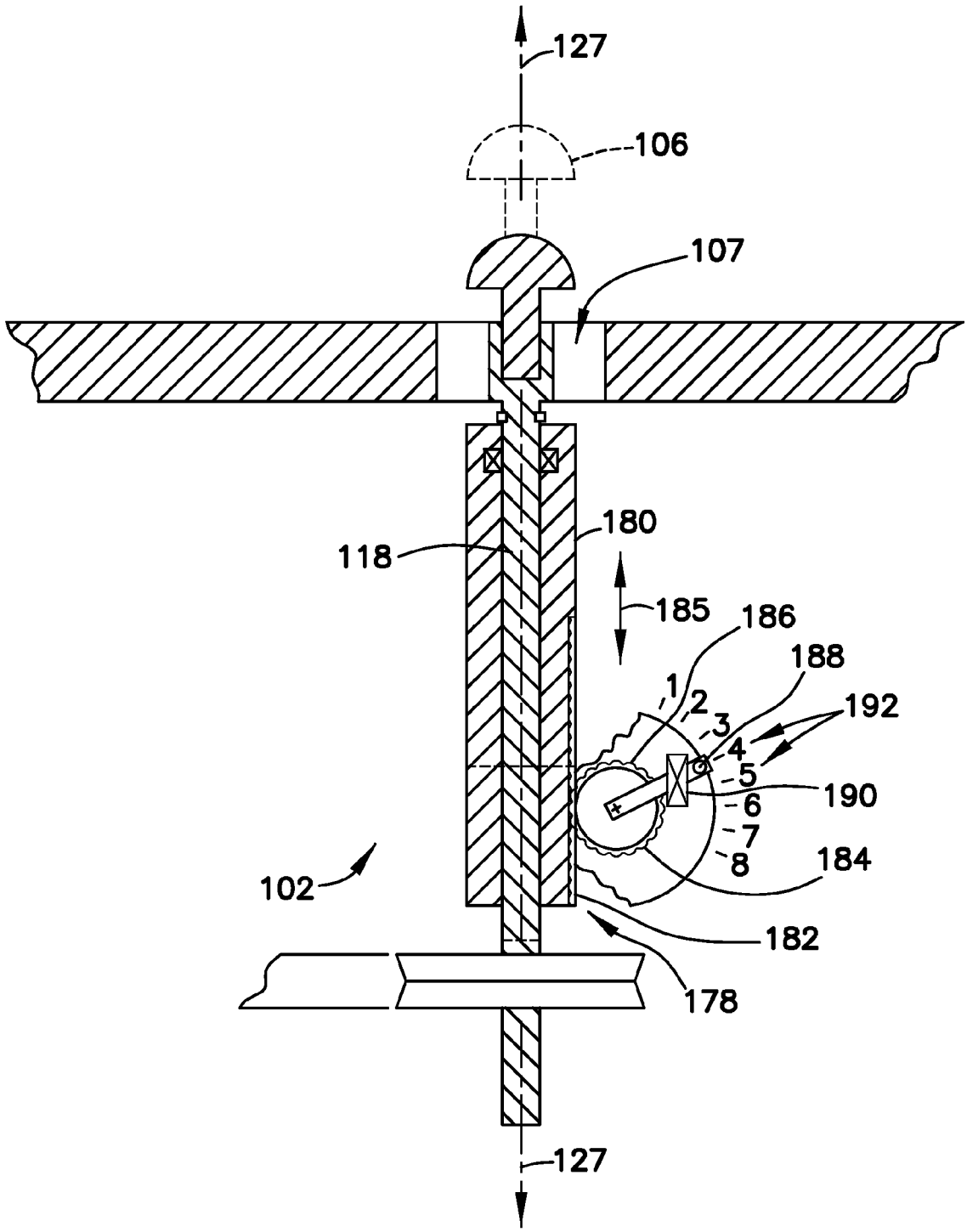
FIG. 6 is a partial cross-sectional view of the router table of FIG. 1 showing a router bit mount in greater detail.

Referring now to FIG. 6, the quill 178 of the router bit mount 102 is shown in greater detail. The quill 178 may include a translating portion 180 having external teeth 182 and a rotating portion 184 having mating teeth 186. The portion with the mating teeth 186 may include a crank 188 for raising and lowering the router bit 106 in the quill 178 along bit axis 127, as indicated by arrow 185. The quill 178 may include a lock 190 to hold the translating portion 180 of the quill 178 in position and a scale or indicia 192 with marks corresponding to selected heights of the various vertical positions of the router bit 106.

Figure 6A:
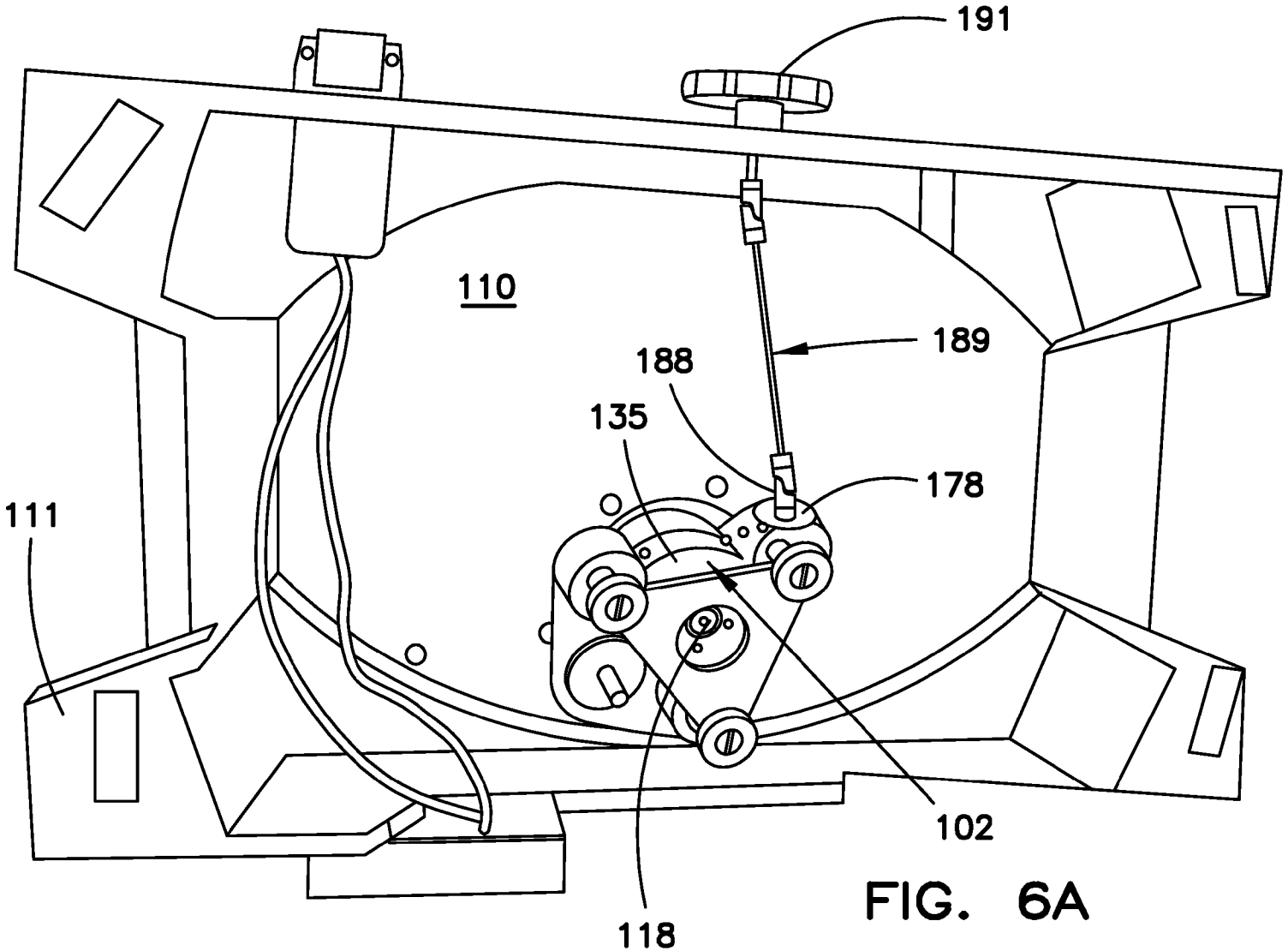
FIG. 6A is a bottom view of the router table of FIG. 1 showing the adjustment mechanism for the router bit mount in further detail.

FIG. 6A shows a bottom view of the table top 110 and bit mount 102. The crank 188 of the quill 178 includes a crank arm 189 and a knob 191. The knob 191 is rotatably supported by the frame 111. The knob 191 is connected to the crank arm 189 such that rotation of the knob 191 results in rotation of the crank arm 188. Accordingly, this embodiment of the quill allows a user to adjust the vertical height of the bit 106 relative to the table top 110 using the knob positioned on the frame 111.

Figure 7:
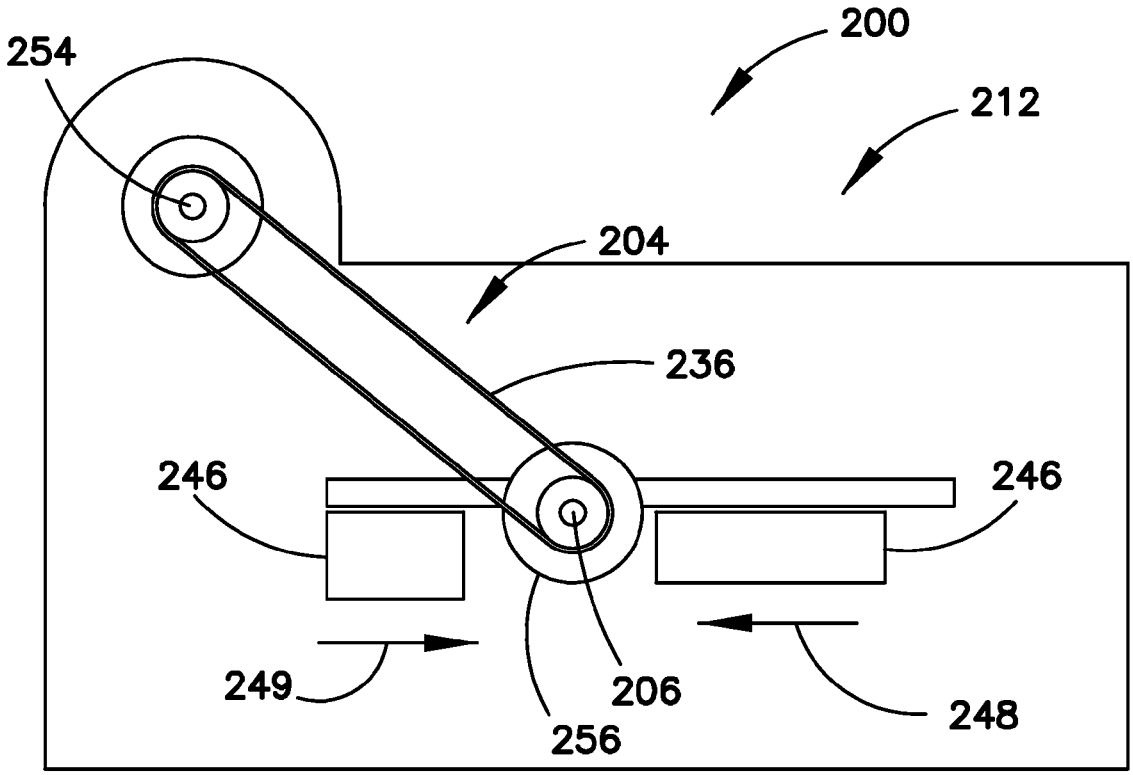
FIG. 7 is a top partially cutaway view of an alternate routing kit for use with router bits.
Figure 7A:
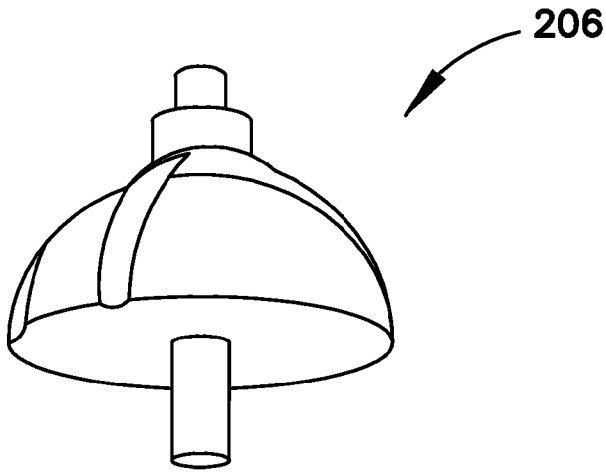
FIG. 7A is a perspective view of a mirror image router bit.

Referring now to FIGS. 7 and 7A another embodiment of the present disclosure is shown in as mechanism 200 for use in router table 212. Mechanism 200 is similar to the router table 100 of FIGS. 1-6, but includes a router bit 206 that has a shape that is the mirror image of the router bit 106. The router bit 206 is shown in greater detail in FIG. 7A. The use of the mirror image shaped router bit 206 permits successful cutting by the router bit 206 with the router table 212 when the workpiece 246 is advanced from left to right in the direction of arrow 249. The use of the router bit 206 permits the utilization of a drive 204 that includes a drive pulley 254 connected by a belt 236 to a mount pulley 256. The drive 204 is substantially simpler than the drive 104. It should be appreciated that, however, the utilization of unique mirror image shaped router bits 206 may not be desired.

The router table 100 may be provided as a plurality of individual members that are sold separately or as a kit that is sold with a plurality of members. The routing table 100 kit provides an operator the ability to choose to shape workpieces with either (i) a stationary workpiece and a translating bit using the portable router 108, or (ii) a moveable workpiece and a rotating, non-translating bit, using the router table 112.

There are numerous advantages arising from the various features of each of the embodiments of the routing kit described herein. It will be noted that alternative embodiments the routing kit may not include all of the features described yet still benefit from at least some of the advantages of such features. Those of ordinary skill in the art may readily devise their own implementations of the routing kit that incorporate one or more of the features described herein and fall within the spirit and scope of the present invention as defined herein. Accordingly, although the present invention has been described with respect to certain preferred embodiments, it will be appreciated by those of skill in the art that other implementations and adaptations are possible. Therefore, the spirit and scope of the appended claims should not be limited to the description of the embodiments contained herein.

What is claimed is

1. A router table comprising:

a table top;

a bit mount configured to hold a router bit such that the router bit extends from the table top, the bit mount defining a bit axis;

a drive train operably connected to the bit mount; and a drive coupling operably connected to the drive train, the drive coupling configured to engage a driven member, the drive coupling defining a drive axis that is not coaxial with the bit axis, wherein the drive coupling is configured to receive the driven member when the driven member is operably connected to an electric motor seated on the table top, wherein the drive coupling is configured to receive the driven member when the driven member is a drive bit connected to a portable router seated on the table top, and wherein the drive coupling is positioned under the table top and the table top includes a drive hole, the drive hole configured to receive the drive bit and allow the drive bit to connect the portable router seated on the table top to the drive coupling positioned under the table top.

2. The router table of claim 1 further comprising a router seat connected to the table top, the router seat configured to secure the portable router on the table top.

3. The router table of claim 1 wherein the table top includes a bit hole with the bit mount extending through the bit hole in the table top.

4. The router table of claim 1 wherein the bit mount is a rotatable chuck or collet operably mounted to an underside of the table top.

5. The router table of claim 1 wherein the bit mount is adjustable relative to the table top along the bit axis.

6. The router table of claim 1 wherein rotation of the drive train comprises a drive belt or a drive chain operably connected between the bit mount and the drive coupling such that rotation of the drive coupling results in rotation of the bit mount.

7. The router table of claim 1 wherein the drive train comprises a plurality of gears operably connected between the bit mount and the drive coupling such that rotation of the drive coupling results in rotation of the bit mount.

8. The router table of claim 1 wherein the drive train is positioned under the table top.

9. The router table of claim 1 wherein the table top comprises a substantially planar upper surface.

10. The router table of claim 1 wherein the bit axis is substantially parallel to the drive axis.

11. A router table comprising:

a table top including an upper surface configured to support a work piece thereon;

a bit mount rotatably supported in relation to the table top;

a portable router supported by the table top, the portable router including a drive shaft; and a drive mechanism positioned beneath the table top, the drive mechanism operably coupled to both the drive shaft and the bit mount, and the drive mechanism being configured to rotate the bit mount in response to rotation of the drive shaft, wherein the portable router is seated on the upper surface of the table top.

12. The router table of claim 11 further comprising a router bit supported by the bit mount.

13. The router table of claim 11 further comprising a drive coupling operably connected to both the drive shaft and the drive mechanism.

14. The router table of claim 13 further comprising a driven member operably coupled to the drive shaft, wherein the table top defines a drive hole, and wherein the drive member extends through the drive hole.

15. The router table of claim 11, wherein:

the table top has a bit hole defined therein, the bit mount extends through the bit hole.

16. The router table of claim 15, wherein at least a portion of said bit mount is positioned below the table top.

17. A router table comprising:

a table top including an upper surface configured to support a work piece thereon;

a bit mount rotatably supported in relation to the table top;

a portable router supported by the table top, the portable router including a drive shaft;

a drive mechanism positioned beneath the table top, the drive mechanism operably coupled to both the drive shaft and the bit mount, and the drive mechanism being configured to rotate the bit mount in response to rotation of the drive shaft;

a router bit supported by the bit mount; and a driven member operably coupled to the drive shaft, wherein the table top has a first hole and a second hole defined therein, wherein the bit mount extends through the first hole, and wherein the drive member extends through the second hole.

18. The router table of claim 17, wherein at least a portion of the router bit is located above the table top.

* * * * *